US006035554A

United States Patent [19]

Duncan

[11] Patent Number: 6,035,554

[45] Date of Patent: Mar. 14, 2000

[54] ASYMMETRICAL REVERSIBLE ARTICLE OF FOOTWEAR

[76] Inventor: Donald L. Duncan, 2412 Briar Rose Dr., Texarkana, Ak. 71854

[21] Appl. No.: 08/928,032

[22] Filed: Sep. 11, 1997

[51] Int. Cl.[7] ..... A43B 3/12; A43B 3/24

[52] U.S. Cl. ..... 36/11.5; 36/100; 36/101; 36/15

[58] Field of Search ..... 36/11.5, 100, 101, 36/113, 116, 15

[56] References Cited

U.S. PATENT DOCUMENTS

| | | | |
|---|---|---|---|
| 945,698 | 1/1910 | Conway | 36/3 B |
| 1,012,245 | 12/1911 | Chase | 36/11.5 |
| 1,410,064 | 3/1922 | Hunt . | |
| 2,409,813 | 10/1946 | Timson | 36/2.5 |
| 3,722,113 | 3/1973 | Birkenstock | 36/11.5 |
| 3,871,116 | 3/1975 | Vanderlinden | 36/11.5 |
| 4,114,296 | 9/1978 | Smith | 36/101 |
| 4,246,707 | 1/1981 | Pedersen | 36/100 |
| 4,267,649 | 5/1981 | Smith | 36/101 |
| 4,300,294 | 11/1981 | Riecken | 36/101 X |
| 4,984,377 | 1/1991 | Schneider | 36/134 |
| 5,459,948 | 10/1995 | Aveni | 36/100 |
| 5,615,497 | 4/1997 | Meschan | 36/36 R |
| 5,737,853 | 4/1998 | Smejkal | 36/11.5 |
| 5,753,336 | 5/1998 | Stull | 428/95 X |
| 5,822,888 | 10/1998 | Terry | 36/100 |

FOREIGN PATENT DOCUMENTS

| | | | |
|---|---|---|---|
| 1119287 | 6/1956 | France | 36/100 |

OTHER PUBLICATIONS

Orvis Catalog, 1997, pp. 95–96 and 101–102.

*Primary Examiner*—Paul T. Sewell
*Assistant Examiner*—Anthony Stashick
*Attorney, Agent, or Firm*—Arnold White & Durkee

[57] ABSTRACT

An asymmetrical article of footwear reversible sole is provided which offers improved performance and fit. The article of footwear is worn on a different foot when reversed. The invention may be shaped to fit the general outline of a person's foot and may be configured to fit the contours of the bottom of the person's foot. Different materials may be used for the different parts of the composite sole thus allowing the reversible, asymmetrical, composite sole to be used in dual purpose situations.

14 Claims, 5 Drawing Sheets

ASYMMETRICAL REVERSIBLE ARTICLE OF FOOTWEAR

BACKGROUND OF THE INVENTION

1. Field of the Invention

The present invention concerns an improved reversible sole for footwear. This sole is reversible—it may be turned over and worn so that what was previously the outsole becomes the insole and vice versa—and asymmetrical so that the sole is fitted to the shape and contour of the human foot.

2. Description of the Prior Art

The general principle of reversible shoes (and consequently, reversible soles) is not new. But the reversible shoes of the prior art suffer from a critical shortcoming: these shoes utilize a design symmetrical about a longitudinal centerline and thus, cannot properly fit a wearer in either of the two possible arrangements.

The human foot is not symmetrical about its longitudinal centerline. The human foot does not come to a point at the middle of the toes. Rather, the human foot is substantially longer at its inner side than at its outer side. All well designed and well made shoes take this physical fact into account in order to provide a good fit. The prior art reversible shoes do not.

Another shortcoming of the symmetrical prior art reversible shoes is a lack of contouring to meet the anatomic shape of the bottom of the human foot. Of particular significance is the lack of arch support in the prior art reversible shoes. It is not possible to provide an arch support in a reversible shoe sole which is worn on the same foot in either of its reversible positions, because in one of those two positions, the arch support will be located on the wrong side of the foot. For example if a prior art reversible shoe has a raised arch support in its first position, that raised support will be positioned under the outside edge of the foot when the shoe is reversed.

SUMMARY OF THE INVENTION

The sole of the present invention is asymmetrical; that is, it is shaped to fit the actual shape of the human foot. This arrangement requires wearing a shoe utilizing the present invention on a different foot when the sole is reversed. For example, if the shoe is initially worn on the right foot, the sole, when viewed from above, will be longer at its left side than at its right side. When the sole is turned over, it will be longer at its right side than at its left side. The sole will no longer fit the wearer's right foot, but it will fit the wearer's left foot. Therefore, by moving the sole to the other foot, the present invention is able to provide a comfortable fit at all times.

The sole of the present invention has two outsoles (i.e., either outer surface of the sole may serve as an outsole) which may be configured to serve two different functions. For example, one side of the sole may be made of a hard rubber compound used in commercially available sport sandals such as those sold under the TEVA trademark The other side of the sole may consist of or be covered by felt, which is known to provide excellent slip resistance in wet conditions (e.g., when wading in a river or stream). Although felt is a superior material for use in wet environments, it is not a durable outsole material in dry environments. Therefore, the configuration just described would allow the wearer to use the hard rubber compound for general use and then reverse the soles before entering a river or stream, thus extending the life of the felt soles. Other dual purpose configurations are also possible.

The asymmetrical, reversible sole of the present invention utilizes, in a preferred embodiment, a first sole and a second sole, which are attached together (there may be additional materials in between the first sole and the second sole). Both the first sole and the second sole are configured to fit the contour of a wearer's foot, but each sole fits a different foot. This arrangement requires the wearer to switch each sole to the other foot when the sole is reversed. In addition, the present invention uses a first selected material on the first sole and a second selected material on the second sole. These selected materials are chosen to provide particular capabilities to the asymmetrical, reversible sole.

DESCRIPTION OF ILLUSTRATIVE EMBODIMENTS

Figure 1:
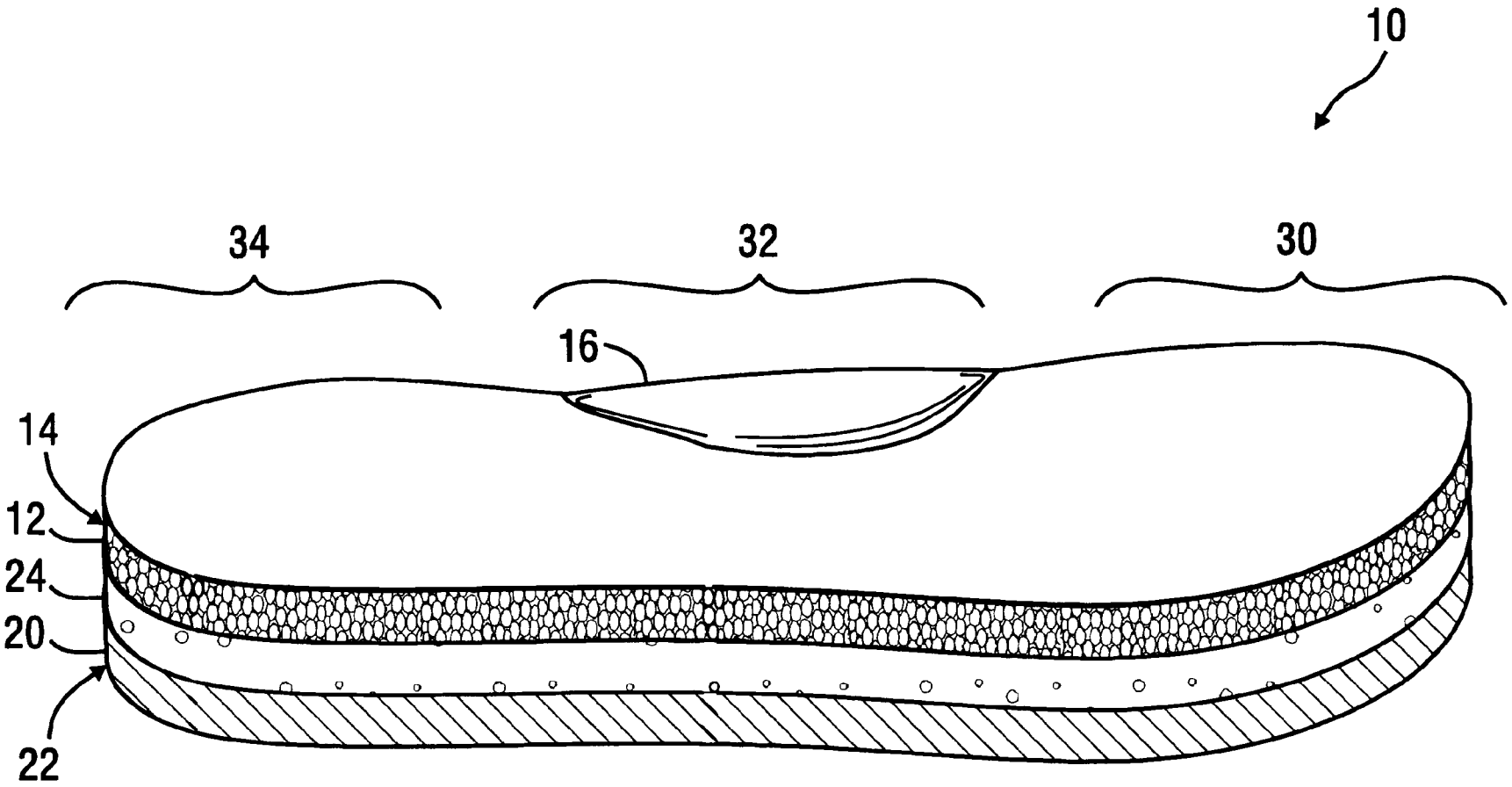
FIG. 1 shows a perspective view of a preferred embodiment of the sole of the present invention.

FIG. 1 shows a perspective view of a reversible sole 10 embodying the present invention. This figure illustrates several important features of the present invention, including the asymmetry of the reversible sole 10. FIG. 1 also shows contouring 16 in the arch area The view of the side of the sole demonstrates that the sole of the present invention may be a composite sole, comprising at least two different sole sections. The first sole 12 is shown in FIG. 1 on the upper side of the asymmetrical, reversible sole 10. This first sole 12 is made of a first selected material 14.

A second sole 20 is shown in FIG. 1 on the bottom side of the asymmetrical, reversible sole 10. This second sole 20 is made of a second selected material 22, which typically will be a different material than the first selected material 14.

A midsole 24 also is shown in FIG. 1. The midsole 24 may be used to provide additional strength, additional cushioning, or for any other purpose desirable in a particular setting. The present invention does not relate to the use and selection of a midsole. The midsole 24 shown in FIG. 1 is presented to make it clear that a device embodying the present invention may include additional materials between the first sole 12 and the second sole 20. The invention also may use a noncomposite, asymmetrical, reversible sole.

Figure 3:
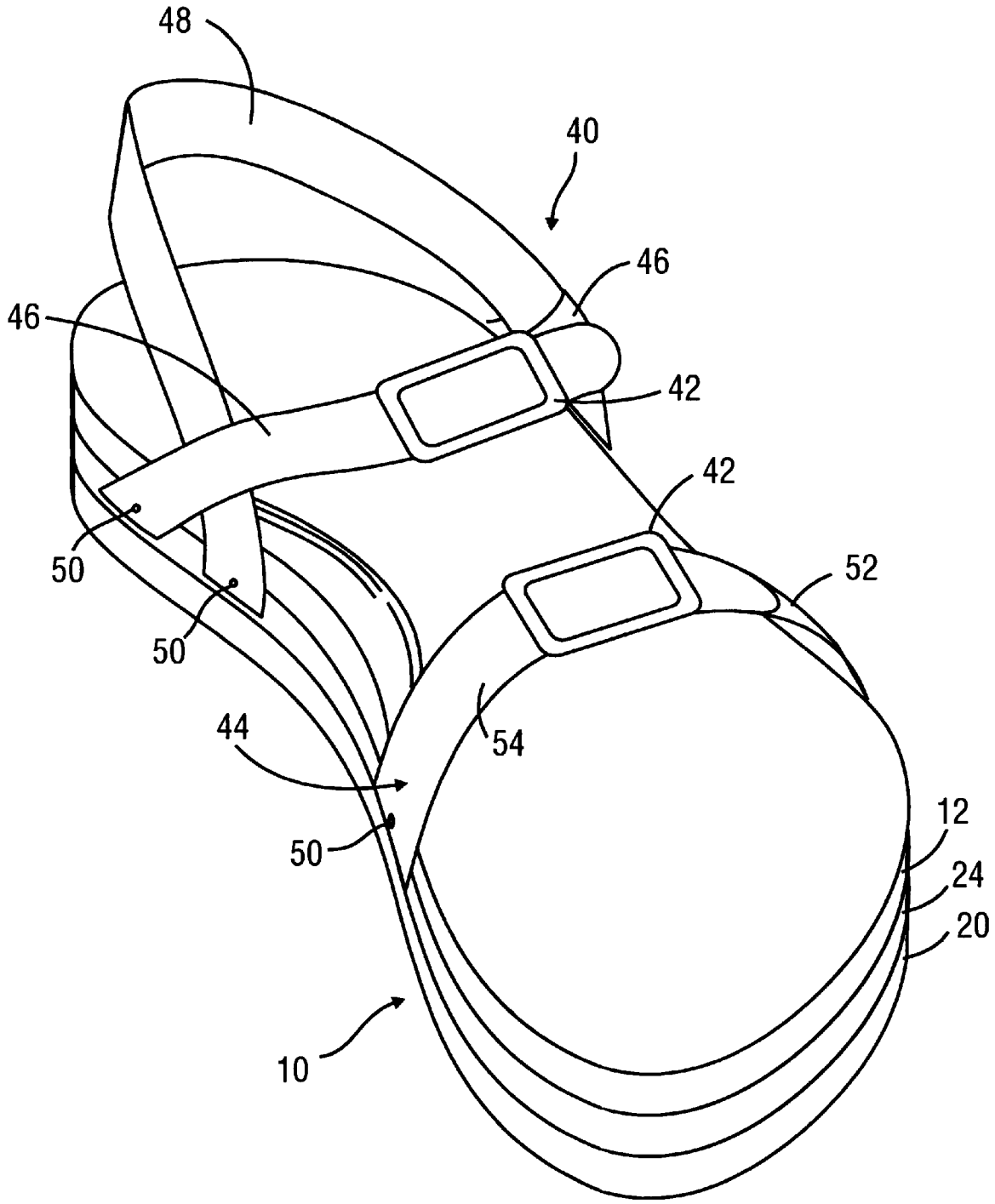
FIG. 3 shows a preferred embodiment of the reversible sole as used in a reversible activity sandal.
Figure 4:
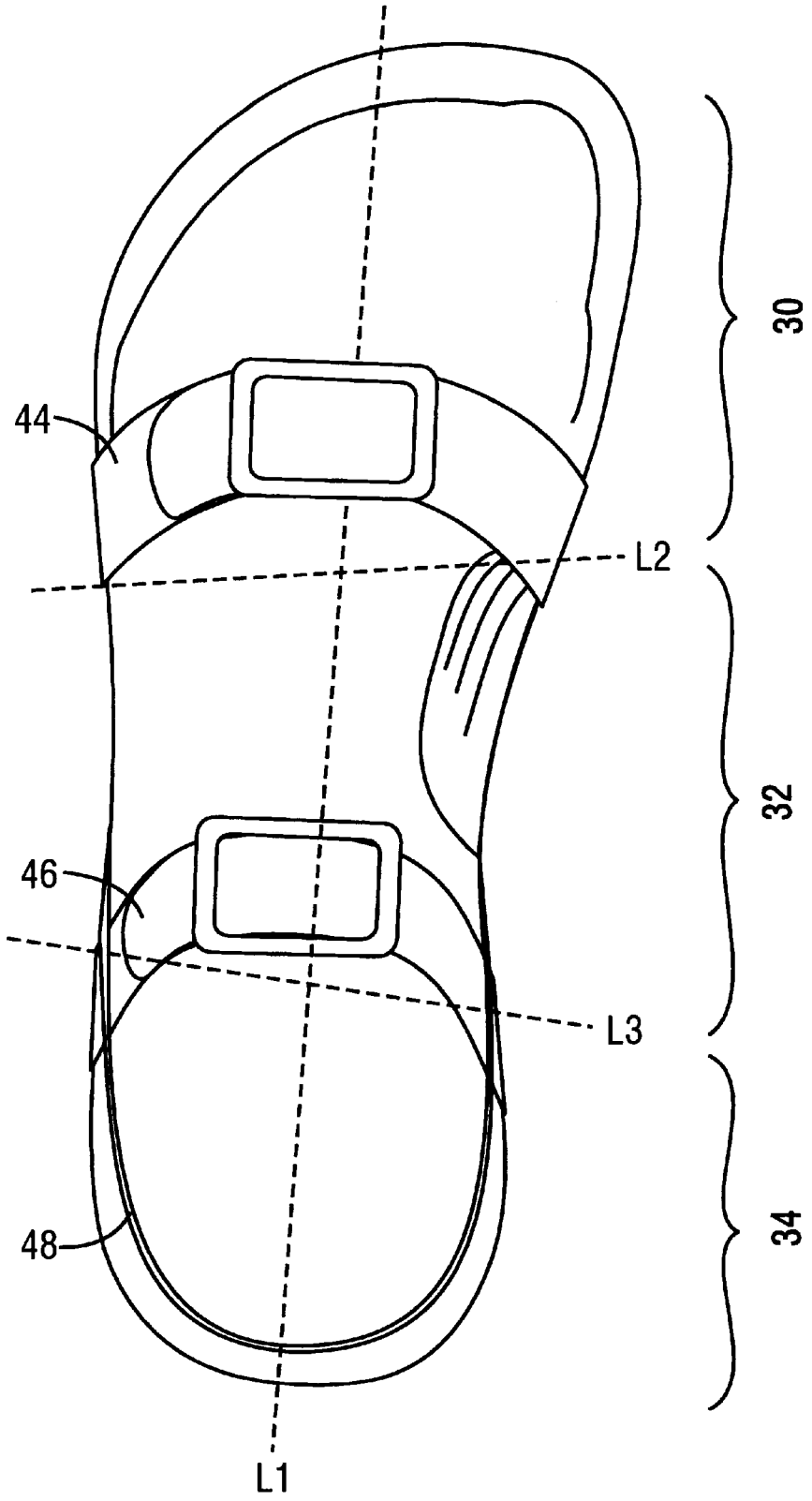
FIG. 4 shows an overhead view of a preferred embodiment of a reversible sole sandal showing the asymmetry of the reversible sole.

The asymmetrical, reversible sole 10 shown in FIG. 1 may be used in various types of shoes. In a preferred embodiment, the asymmetrical, reversible sole 10 of the present invention is used in an activity sandal. This embodiment is illustrated in FIG. 3 and FIG. 4, and is described below. But many other types of shoes may utilize the asymmetrical, reversible sole 10 of the invention. This invention may be used with sandals, boots, overshoes, athletic shoes, casual shoes, and any other type of shoe designed to allow for reversing the upper of the shoe. The upper may be made of various flexible materials; in the preferred sandal, the upper may consist of straps.

FIG. 1 shows an asymmetrical, reversible sole 10 of the present invention, apart from an upper. This illustration thus provides an unfettered perspective view of a preferred embodiment of the invention. This embodiment has a contoured front section 30 that is shaped to fit the human foot. It is longer on the inside (i.e., the side which corresponds to the inside of the wearer's foot) than the outside because the human foot is similarly shaped. In addition, the embodiment shown in FIG. 1 has a curved mid-section 32 which further corresponds to the shape of the human foot. The curvature of the midsection 32 is a concave, similar to that used with most well made shoes. The asymmetrical, reversible sole 10 is thereby similar in shape to the lasts used with most well made shoes.

Most well made shoes have a roughly hourglass shape. The front section of the last is the widest section, as is the front section 30 of the asymmetrical, reversible sole 10 shown in FIG. 1. The middle area is the narrowest part of the last, with both sides curving inward at the middle. This same characteristic is seen in FIG. 1. The heel section 34 is wider than the middle section 32, but is narrower than the front section 30.

The curvature of the inside of a typical last (i.e., the side that corresponds to the inside of the wearer's foot) is more pronounced than the outside. This curvature corresponds to the arch of the typical human foot. The asymmetrical, reversible sole 10 shown in FIG. 1 is also shaped in this way. In other words, sole 10 of the present invention is asymmetrical about its longitudinal axis. Prior art reversible shoes lack this asymmetry.

The asymmetrical, reversible sole 10 of the present invention provides a substantially better fit than the reversible soles of the prior art. In addition, the sole 10 may utilize two different materials for the first sole 12 and second sole 20. Such a configuration enables the sole 10 to be used for different activities or in different conditions. The benefits of this configuration can be best explained through examples.

One important use of the present invention is in fishing. Many persons walk or wade in the water (e.g., streams, rivers, or lakes) to fish. This practice is particularly common when fly fishing. Standing and walking in the water, however, can be difficult because of the slippery rocks often encountered in such settings. Certain materials perform well in this environment, but do not perform well in a dry environment Felt is often used by serious fly fishers, as can be seen from the products offered in the ORVIS catalog, which is a leading supplier of fly fishing products. The ORVIS catalog currently offers at least three different wading shoes using felt outsoles.

The problem posed by using felt as an outsole on a shoe is that felt will not last long in a dry environment. When a felt outsole is used for hiking or walking on the dry ground, the felt will quickly be torn or worn down. Thus, the felt-bottomed wading shoes used for fly fishing are normally carried to the stream, river, or lake. The fisher then takes off his or her hiking or walking shoes and puts on the felt bottomed wading shoes to enter the river or stream. This requires the fisher to carry another item to and from the fishing location. And these wading shoes often resemble hiking boots in size, making this additional item a substantial inconvenience.

Many persons wear activity sandals when fishing in warm streams, rivers, or lakes. These sandals have become popular over the last several years and are offered under brands such as TEVA. Straps are used to hold the sandals on the foot and a hard compound rubber is generally used for the outsole to provide good durability. These sandals work well for walking in dry environments, but their hard rubber outsoles do not provide good traction in the water. A different sandal or shoe with a different outsole material is needed for walking or wading on slippery rocks in rivers, streams, and lakes.

In one especially preferred embodiment of the present invention, the first selected material 14 is felt. The felt side of the sole 10 is worn next to the foot when used in a dry environment. The second selected material 22 is a hard rubber compound similar to that used in TEVA sandals and other activity sandals. The second sole 20 is the outsole when the sole 10 is used in dry environments. Just before the wearer enters a wet environment, such as a river or stream, he or she turns the sole 10 over and switches it to the other foot This feature is particularly advantageous to fishers, kayakers, and other persons who engage in activities that involve both dry and wet environments. This feature also may be advantageous to persons who wear sandals or other shoes when showering.

Figure 2A:
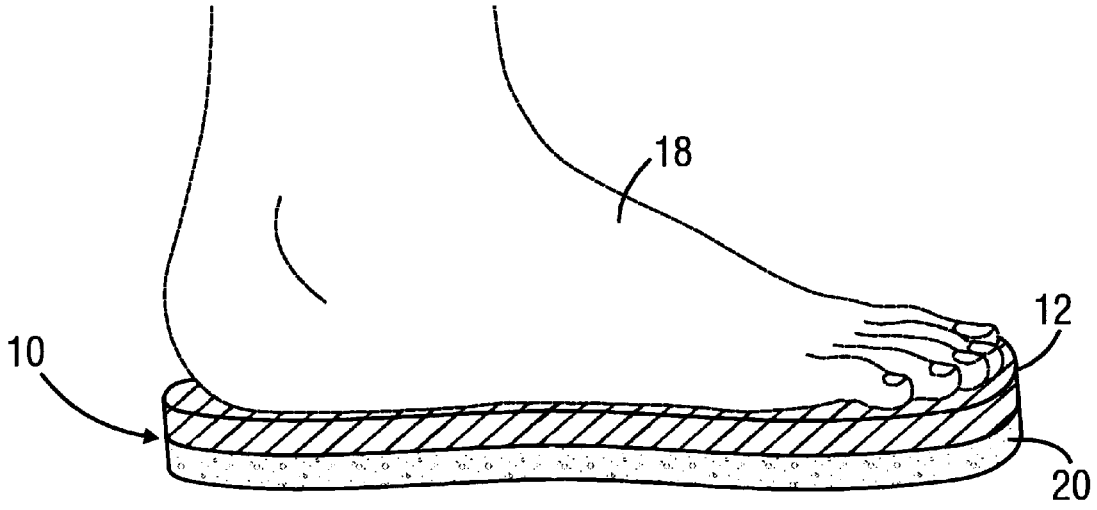
FIG. 2 illustrates a feature of the present invention, namely that the reversible sole is worn on one foot in a first configuration and on the other foot when reversed to a second configuration.
Figure 2B:
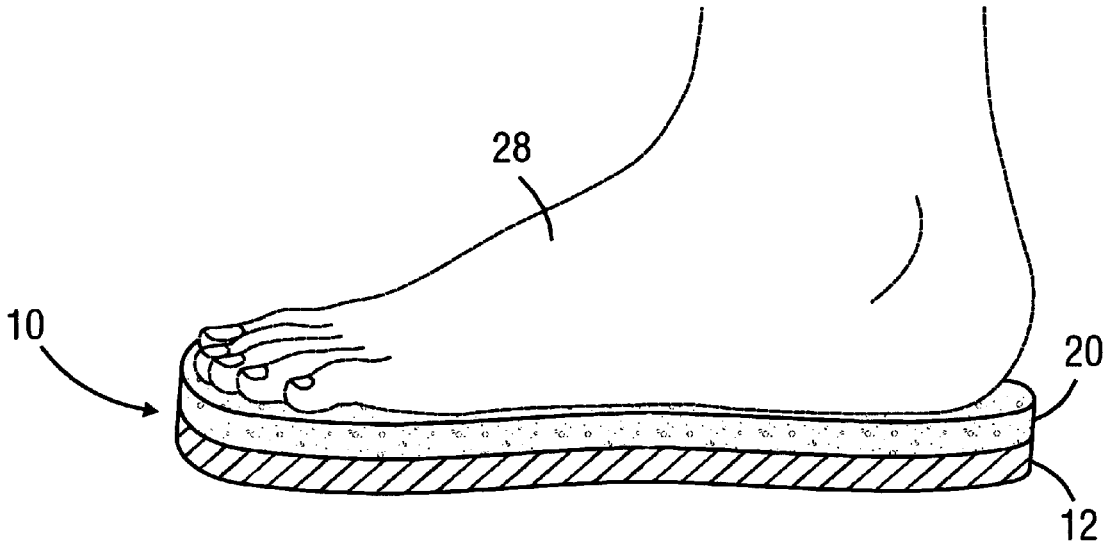

The switching made possible by the invention is illustrated in FIG. 2A and FIG. 2B. The first sole 12 in this embodiment is worn next to the right foot 18 (i.e., the first sole is the insole) for use in a dry environment The second sole 20 is the ground contact surface (i.e., the second sole is the outsole) for use in a dry environment. When the user decides to reverse the sole (e.g., to engage in a different activity), he or she takes each shoe off, turns each shoe over, and then puts each shoe on the other foot Thus, in FIG. 2B, the sole 10 is used with the shoe worn on the left foot 28, and the first sole 12 has become the outsole, while the second sole 20 has become the insole. The shoe is now ready for use in a wet environment.

The switching explained in the preceding paragraph also enables the present invention to provide an asymmetrical, reversible sole 10 that is contoured to fit the bottom of the human foot, feature absent from prior art reversible shoes. FIG. 1 shows, through the use of shading, that the asymmetrical, reversible sole 10 has a raised arch support 16. This raised support is provided in the first sole 12 in the embodiment shown in FIG. 1, but could alternatively be located on the second sole 20. In either case, when the asymmetrical, reversible sole 10 is reversed, the raised arch support 16 contacts the ground. The raised arch support 16 then is pushed upward as a result of the weight of the wearer and thus becomes an arch support for the other foot Arch support 16 is illustrated in FIG. 1, but other contouring (e.g., in the toe area, ball of the foot area, and heel area) may also be utilized. Such contouring is used in many nonreversible shoes, including many activity sandals, and is therefore known to persons skilled in the art The asymmetrical, reversible sole 10 of the present invention also may be used in other dual function settings. For example, rock climbers often use shoes with a soft rubber outsole to improve traction when climbing. These rubber compounds are not as durable as the harder compounds typically used on general purpose shoes. The invention might be used to create a reversible climbing shoe having a desired soft rubber sole as a first sole 12, which can be positioned as an insole except when needed for climbing. Such a reversible climbing shoe might use a hard rubber compound for a second sole 20, which may be used as the outsole, except when the softer first sole 12 is needed for climbing.

Another dual function application of the present invention is a reversible athletic shoe. Such a shoe might have a sole designed for a particular type of playing surface as a first sole 12. A more general purpose rubber compound might be used as a second sole 20. Alternatively, the second sole 20 may be specifically material designed for use on a playing surface different from that for which the first sole 12 is intended. For example, a basketball shoe may be made using a first sole 12 of a material selected to provide satisfactory traction and durability on a hardwood playing surface and a second sole 20 might be designed to provide acceptable traction and durability on a cement, concrete, or asphalt playing surface. The demands of these two surfaces are substantially different and the sole 10 enables one shoe to work well in both settings.

The sole 10 may use the same material for the first sole 12 and second sole 20. This configuration may extend the life of the shoe.

The preceding examples of dual function reversible shoes utilizing the present invention are illustrative and not exhaustive. Persons skilled in the art will recognize many other potential applications of the present invention.

The present invention provides a good fitting sole in either of its two reversible positions. This result is achieved primarily through the shaping and contouring of the first sole 12 and second sole 20. By providing a good fit in both positions, the present invention reduces or eliminates the need for a removable insole or sock liner, which must be used with some prior art reversible soles. Some prior art reversible shoes need an additional insole contoured to the foot so that an acceptable fit is achieved. Although a padded, removable insole or sock liner may be used with the present invention, such an additional insole is not required to achieve a good fit and good performance.

A sandal embodiment of the present invention is shown in FIG. 3 and FIG. 4. This sandal is a dual purpose sandal and embodies the sole 10 of FIG. 1. In this preferred embodiment of the invention, the sole 10 uses felt as the first selected material 14 and a hard rubber compound for the second selected material 22. This embodiment is designed for use in both wet environments (using the first sole as an outsole) and dry environments (using the second sole as an outsole). Fishing is an anticipated application of this preferred embodiment.

The reversible sandal 40 shown as FIG. 3 and FIG. 4 may be used for normal walking and for wading in shallow water or walking on slippery, wet rocks. It includes an asymmetrical, reversible sole 10 having a first sole 12, a second sole 20, and a midsole 24. The first sole 12 is attached to the midsole 24 using adhesive, or by sewing, or in any other suitable manner. The second sole 20 is attached to the other side of the midsole 24.

The embodiment shown in FIG. 3 AND FIG. 4 has a first sole 12 made of felt and a second sole 20 made of a hard rubber compound. The felt of the first sole 12 is typically about ¼" in thickness, and the entire sole 10 is typically about ¾" in thickness. (The thickness of the sole 10 may vary a great deal depending upon the application.) If no midsole 24 is used, the second sole 20 is typically about ½" in thickness, or roughly twice the thickness of the first sole 12. If a midsole 24 is used, the first sole 12 and second sole 20 may be closer in thickness.

A midsole 24 may be desirable to provide additional cushioning. The felt of the first sole 12 is soft, but the rubber compound of the second sole 20 typically is not soft If the harder second sole 20 constitutes the majority of the sole 10, the entire sole may be rather hard. This should not affect the general fit and performance of the sandal 40, but comfort may be increased by using a cushioning (i.e., shock absorbing) midsole 24. Such a sole might be made of any suitable material.

The second sole 20 may have a tread pattern to enhance traction on dry surfaces and the tread pattern may vary in different regions of the second sole 20 to further improve traction, performance, and durability. Tread patterns are well known in the art and are currently used on many activity sandals, hiking boots, and other types of shoes.

The sandal 40 shown in FIG. 3 and FIG. 4 uses several securing straps, which may utilize any suitable fastening means 42 known in the art. In a most preferred embodiment, a hook and loop fastener is used, such as is available under the VELCRO brand. Other fasteners (e.g., buckles, snaps, buttons, etc.) also may be used.

In the embodiment shown in FIG. 3 and FIG. 4, the sandal 40 has a pair of front straps 44, a pair of rear straps 46, and a heel strap 48. The front straps 44 secure the sandal 40 to the front part of the foot and are positioned near the base of the wearer's toes. The rear straps 46 and heel strap 48 work together to secure the sandal 40 to the heel of the foot. The rear straps 46 are positioned around the front of the ankle and the heel strap 48 encircles the back of the ankle. These sets of straps hold the sandal 40 securely in place. The straps shown in FIG. 3 and FIG. 4 are similar to those used in well-known activity sandals.

The straps of the sandal 40 are attached to sole 10 near the middle of the sole as viewed from the side. The straps may be attached between the first sole 12 and the second sole 20 where no midsole is used, or between the midsole 24 and the second sole 20 where a midsole is used. It is also possible to attach the straps between the first sole 12 and a midsole 24, but such an arrangement may not provide as reliable performance where the first sole 12 is made of felt or another soft fabric.

The straps are preferably attached to the sole 10 such that the straps remain in the same relative position when the sandal 40 is reversed. For example, the straps may be pivotally connected to the sole 10 using a swivel 50 or other pivoting means. By allowing the straps to pivot or swivel, the straps remain in their normal alignment even when the sandal 40 is reversed. This result may be desirable if the straps are configured with a fastener 42 on only one side. In such a configuration the right front strap 52 might have a hook and loop type fastener on its top surface when the sandal 40 is in its first position. The left front strap 54 may have a mating fastener on its bottom surface so that the left front strap 54 is positioned over the right front strap 52 to secure the sandal 40. When reversed, straps configured in this way might not work properly unless the straps remained in their original alignment. By using a swivel 50 or other pivoting means (e.g., hinges, pins, etc.), the straps may maintain their normal alignment even when the sole 10 is reversed.

Alternatively, a single strap may have hook and loop fasteners at two locations along its length. This strap may be passed through a loop positioned at the end of the other corresponding strap. The first strap is pulled tight through the loop and then attached to itself using the hook and loop fastener. This arrangement is commonly used on activity sandals (e.g., TEVA sandals). To help ensure that the same strap arrangement exists when the sandal 40 is reversed, the straps may pivot or swivel about the side of the asymmetrical, reversible sole 10.

The straps also may be recessed into the side of the sole 10 to prevent the straps from protruding out from the side of the sandal 40. This arrangement might help prevent snagging the straps on items when wearing the reversible sandals 40.

FIG. 4 shows an outline of the sole 10 formed into the approximate shape of a human foot, and generally divided into a heel section 34, a mid-section 32 and a front section 30. The front section 30 generally is asymmetric about the sole's longitudinal axis L1. The mid-section 32 adjoins the front section 30 approximately of the line L2. The mid-section 32 is also asymmetric about the longitudinal axis L1. the mid-section 32 adjoins the heel section 34 approximately at the line L3. These lines and areas are meant to be diagrammatic of characteristics showing the asymmetry of the sole 10.

Figure 5:
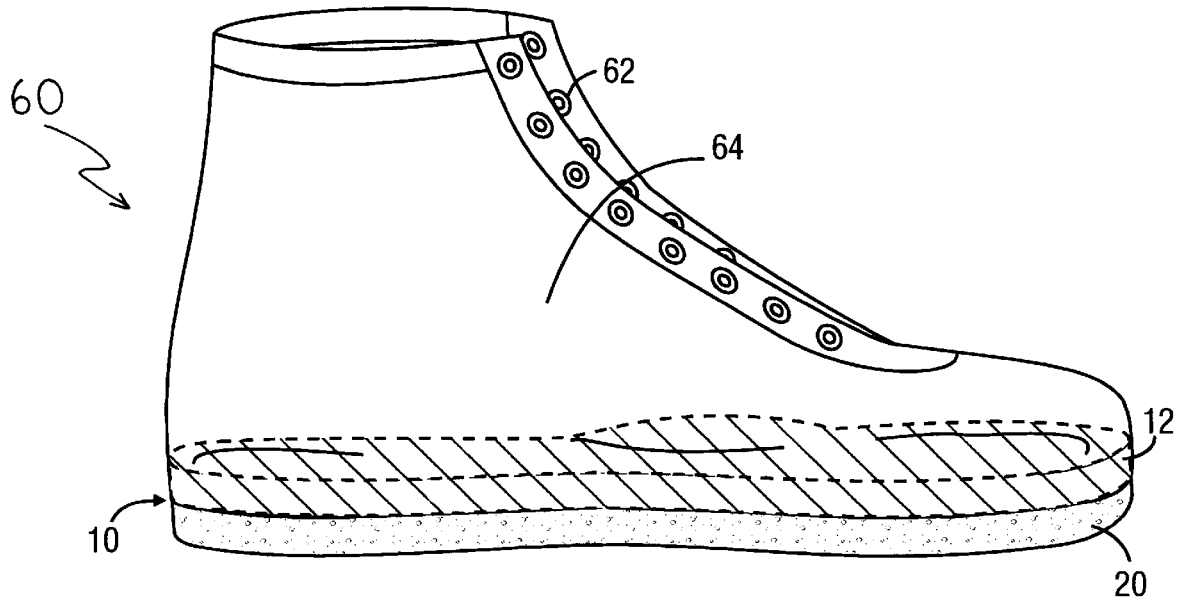
FIG. 5 is an illustration of a reversible shoe using the reversible sole of the present invention.

FIG. 5 shows a reversible shoe 60 which uses the asymmetrical, reversible sole 10 of the invention. The reversible shoe 60 has eyelets 62 for laces. The shoe 60 must be configured so that the upper 64 can be reversed about the sole 10. Laces, hook and loop fasteners, buckles, or other means may be used to secure the shoe 60 to the foot, but the shoe 60 must have a flexible upper 64 which is open to near its front to allow reversing. In addition, the upper 64 may be attached to sole 10 near the middle to facilitate reversing the shoe 60. The upper 64 may be attached to the sole 10 in much the same way as the straps of the sandal 40 (see FIG. 3 and FIG. 4), except that no swivel or pivoting means is needed. The sole 10 has a first sole 12 and a second sole 20.

The preceding description is directed to several exemplary embodiments of the invention. These embodiments illustrate the advantages of the invention and describe certain anticipated uses of the invention. It will be appreciated, however, by those skilled in the art that other embodiments and alternatives of the embodiments described above may be made without deviating from the spirit or scope of the invention. It is intended that the following claims embrace the embodiments described above and any other embodiments, variations, or changes that are consistent with the spirit and scope of the invention.

What is claimed is:

1. An article of footwear comprising a reversible, asymmetrical sole, the sole being asymmetrical about its longitudinal axis and having a first outer surface that includes an arch support and that is configured to fit a person's first foot, and a second outer surface opposed to the first outer surface and configured to fit the person's second foot.

2. The article of footwear of claim 1, wherein the first outer surface is adapted to be worn under a first set of conditions and the second outer surface is adapted to be worn under a second set of conditions.

3. The article of footwear of claim 2, wherein the sole is a composite of two or more subsoles.

4. The article of footwear of claim 3, wherein at least two of the two or more subsoles consist of different materials.

5. The article of footwear of claim 4, wherein a first subsole of the composite comprises an elastomer and a second subsole of the composite comprises a fabric.

6. The article of footwear of claim 2, wherein the first set of conditions comprises wet conditions and the second set of conditions comprises dry conditions.

7. An article of footwear comprising:

a sole having opposing first and second outer surfaces asymmetrically shaped about the sole's longitudinal axis to fit the bottom of a human foot, the first surface having an arch support and being adapted to support the right foot of a person and the second surface adapted to fit the left foot of the person; and, a reversible upper attached to the sole in a first configuration to hold the right foot of the person against the first surface, and in a second configuration to hold the left foot of the person against the second surface.

8. The article of footwear of claim 7, wherein the upper comprises at least one pair of straps attached at first ends to opposing sides of the sole and interengaging one another proximate to their second ends.

9. The article of footwear of claim 8, wherein the first ends of the at least one pair of straps are pivotally connected to the sole.

10. The article of footwear of claim 8, wherein the opposing sides of the sole comprise recesses for the at least one pair of straps.

11. A sandal comprising an asymmetrical, reversible, composite sole, the sole being asymmetrical about its longitudinal axis and having a first outsole and a second outsole, the first outsole comprising a first material which is adapted to provide adequate traction in set conditions and the second outsole comprising a second material which is adapted to provide durability in dry conditions, where the first material comprises an elastomer and the second material comprises felt and where the first set of conditions comprises dry conditions and the second set of conditions comprises wet conditions.

12. The sandal of claim 11, where the first set of conditions further comprises standing or walking in water or on wet surfaces.

13. The sandal of claim 12, where the first set of conditions further comprises standing in water while fishing.

14. The article of footwear of claim 1, wherein the first outer surface is made of a material selected to provide adequate traction in wet conditions and the second outer surface is made of a material selected to provide durability in dry conditions.

* * * * *